US009067698B2

(12) United States Patent
Stolte et al.

(10) Patent No.: US 9,067,698 B2
(45) Date of Patent: Jun. 30, 2015

(54) METHOD FOR THE FILLING OF BEVERAGE CANS IN A BEVERAGE CAN FILLING PLANT, A METHOD FOR THE FILLING OF CANS IN A CAN FILLING PLANT, AND AN APPARATUS THEREFOR

(75) Inventors: Thomas Stolte, Bad Kreuznach (DE); Timo Jakob, Framersheim (DE)

(73) Assignee: KHS GmbH, Dortmund (DE)

( * ) Notice: Subject to any disclaimer, the term of this patent is extended or adjusted under 35 U.S.C. 154(b) by 409 days.

(21) Appl. No.: 12/432,407

(22) Filed: Apr. 29, 2009

(65) Prior Publication Data

US 2009/0266439 A1 Oct. 29, 2009

Related U.S. Application Data

(63) Continuation-in-part of application No. PCT/EP2007/009357, filed on Oct. 29, 2007.

(30) Foreign Application Priority Data

Oct. 31, 2006 (DE) ..... 10 2006 051 237

(51) Int. Cl.

| | |
|---|---|
| ***B65B 31/04*** | (2006.01) |
| ***B67C 3/10*** | (2006.01) |
| ***B08B 9/08*** | (2006.01) |
| ***B08B 9/093*** | (2006.01) |

(52) U.S. Cl.

CPC ..... *B65B 31/042* (2013.01); *B67C 3/10* (2013.01); *B08B 9/0813* (2013.01); *B08B 9/093* (2013.01)

(58) Field of Classification Search

CPC B67C 2003/2657; B67C 3/10; B67C 3/2642; B67C 3/222; B65B 31/041; B65B 31/042; B65B 31/04; B65B 55/00; B65B 55/24; B65B 31/06

USPC ..... 53/432, 428, 403, 408, 79, 84, 88, 90, 53/510, 111 R, 407; 141/4–6, 47, 48, 51, 141/63

IPC ..... B67C 3/10; B65B 31/04

See application file for complete search history.

(56) References Cited

U.S. PATENT DOCUMENTS

| | | | | |
|---|---|---|---|---|
| 2,126,563 | A * | 8/1938 | Lee | 141/54 |
| 2,361,641 | A * | 10/1944 | McKinnis | 141/70 |
| 2,518,856 | A * | 8/1950 | Bell | 53/406 |
| 3,780,308 | A * | 12/1973 | Nablo | 250/492.3 |
| 3,951,186 | A * | 4/1976 | Mencacci | 141/5 |

(Continued)

FOREIGN PATENT DOCUMENTS

| | | | | |
|---|---|---|---|---|
| CH | 615871 | A5 * | 2/1980 | B65B 31/041 |
| DE | 2123255 | A1 * | 11/1972 | B67B 3/10 |

(Continued)

OTHER PUBLICATIONS

International Search Report PCT/EP2007/009357 and English translation thereof, mailed Mar. 4, 2008, 4 pages.

(Continued)

*Primary Examiner* — Stephen F Gerrity

(74) *Attorney, Agent, or Firm* — Nils H. Ljungman & Associates

(57) ABSTRACT

A method for the filling of beverage cans in a beverage can filling plant, a method for the filling of cans in a can filling plant, and an apparatus therefor.

18 Claims, 3 Drawing Sheets

(56) References Cited

U.S. PATENT DOCUMENTS

| | | | | | |
|---|---|---|---|---|---|
| 4,148,933 | A | * | 4/1979 | Janovtchik | 426/402 |
| 4,688,608 | A | * | 8/1987 | Puskarz et al. | 141/39 |
| 4,693,054 | A | * | 9/1987 | Spargo | 53/432 |
| 4,964,259 | A | * | 10/1990 | Ylvisaker et al. | 53/433 |
| 5,000,234 | A | | 3/1991 | Weiss | |
| 5,001,878 | A | * | 3/1991 | Sanfilippo et al. | 53/510 |
| 5,040,574 | A | * | 8/1991 | Petri et al. | 141/39 |
| 5,069,020 | A | * | 12/1991 | Sanfilippo et al. | 53/510 |
| 5,161,585 | A | * | 11/1992 | Murao et al. | 141/39 |
| 5,228,269 | A | * | 7/1993 | Sanfilippo et al. | 53/432 |
| 5,445,194 | A | | 8/1995 | Clusserath | |
| 6,076,567 | A | * | 6/2000 | Naecker et al. | 141/47 |
| 6,109,483 | A | * | 8/2000 | Wilke et al. | 141/47 |
| 6,139,796 | A | * | 10/2000 | Kristiansson et al. | 422/22 |
| 6,155,314 | A | * | 12/2000 | Ding et al. | 141/47 |
| 6,508,047 | B1 | * | 1/2003 | Groppi | 53/432 |
| 7,040,075 | B2 | * | 5/2006 | Seebeger et al. | 53/432 |
| 2004/0208781 | A1 | | 10/2004 | Hayashi et al. | |
| 2004/0222224 | A1 | | 11/2004 | Plester | |

FOREIGN PATENT DOCUMENTS

| | | | | |
|---|---|---|---|---|
| DE | 38 36 489 | | 5/1990 | |
| DE | 40 36 290 | | 12/1991 | |
| EP | 0 614 850 | | 9/1994 | |
| EP | 691303 | A1 * | 1/1996 | B67C 3/04 |
| EP | 1 236 521 | | 9/2002 | |
| JP | 2005-313928 | | 11/2005 | |

OTHER PUBLICATIONS

International Preliminary Report on Patentability PCT/EP2007/009357 and English translation thereof, mailed May 14, 2009, 14 pages.

English translation of Mexican Office Action MX/a/2009/004228, mailed Dec. 9, 2011, 2 pages.

* cited by examiner

METHOD FOR THE FILLING OF BEVERAGE CANS IN A BEVERAGE CAN FILLING PLANT, A METHOD FOR THE FILLING OF CANS IN A CAN FILLING PLANT, AND AN APPARATUS THEREFOR

CONTINUING APPLICATION DATA

This application is a Continuation-In-Part application of International Patent Application No. PCT/EP2007/009357, filed on Oct. 29, 2007, which claims priority from Federal Republic of Germany Patent Application No. 10 2006 051 237.5, filed on Oct. 31, 2006. International Patent Application No. PCT/EP2007/009357 was pending as of the filing date of this application. The United States was an elected state in International Patent Application No. PCT/EP2007/009357.

BACKGROUND

1. Technical Field

The present application is related to a method for the filling of beverage cans in a beverage can filling plant, a method for the filling of cans in a can filling plant, and an apparatus therefor.

2. Background Information

Background information is for informational purposes only and does not necessarily admit that subsequently mentioned information and publications are prior art.

The present application relates to an apparatus for the introduction of a flushing or displacement gas into cans to be filled with foods or beverages, in one possible embodiment beverage cans.

In bottles to be filled with foods or beverages, for example, some methods describe the removal of the air that comprises oxygen by evacuation and successive flushing with carbon dioxide ($CO_2$). If this technology were to be applied to beverage cans to be filled, however, the result would be the implosion of the very thin-walled beverage cans because of the evacuation step, which would render them unusable.

In another method, the open cans are continuously or substantially continuously flushed with carbon dioxide. Of course, that achieves the desired flushing effects, although this method has the major disadvantage that there is a concentration of carbon dioxide in the immediate or general vicinity of the corresponding equipment, as a result of which the machine operator is exposed to a high maximum workplace concentration of carbon dioxide.

OBJECT OR OBJECTS

This is a problem addressed by the present application. An object of the present application is to create an apparatus with which an optimal flushing action of cans to be filled with foods or beverages can be achieved without any adverse effect on the environment such as excessive carbon dioxide levels, for example.

SUMMARY

With an apparatus of the type described above, the present application teaches that this object is accomplished by an apparatus for the introduction of a flushing or displacement gas into cans to be filled with food or beverage, in one possible embodiment beverage cans, namely by a sleeve which can be raised and lowered and comes into contact with a seal located on the upper edge of the can, in which sleeve a flushing gas tube is guided so that it can be raised and lowered, and which is equipped with a gas exhaust line.

In at least one possible embodiment of the present application where a can is open and is initially filled with atmospheric air, by means of the raising and lowering of the flushing gas tube, the flushing gas can be introduced into the vicinity of the bottom of the can, whereby this mixture of flushing gas and air can be removed by means of a gas exhaust line.

It is thereby also possible to optionally reprocess the mixture of flushing gas and air and to re-use the flushing gas in the process. It is also possible, however, to dispose of the mixture through the roof of the building. In both cases, the user environment of an appropriately equipped machine is significantly improved because it is no longer polluted by carbon dioxide or a smog of flushing gas.

The atmosphere inside the can is significantly or generally improved, so that the possibility of the entry of oxygen or unwanted gas is minimized even during the subsequent filling process, which leads to an improvement in the quality of the end product.

Realizations of the present application are described according to the present application.

In at least one possible embodiment of the present application, the valve cylinder which guides the flushing gas tube is surrounded externally by a sleeve which is sealed with respect to this valve cylinder and during the flushing process is in contact by means of its sealing edge with the upper edge of the sleeve. If the valve cylinder has two areas with different diameters so that there is an annular shoulder, this area can be used to form the beginning of the gas discharge line.

The terminal portion of the valve cylinder, which has a tapered diameter, is designed so that an annular space is formed between the terminal area of the sleeve that supports the edge seal and the valve cylinder for the above mentioned removal of the mixture of flushing gas and air.

A vacuum pump can also be provided on the exhaust gas line to improve and accelerate the flushing process.

The method of operation that corresponds to the flushing process according to the present application comprises lowering a sleeve which is provided with an edge seal onto the upper edge of a can to be flushed and positioning it in sealed contact with this edge, then lowering a valve cylinder that carries the flushing gas delivery tube and an exhaust gas line into the can until the discharge opening of the flushing gas tube is in the vicinity of the bottom of the can, leaving an area free for the discharge of the flushing gas, and opening the flushing gas feed line and the exhaust line until the can is completely filled with flushing gas.

In at least one possible embodiment, the mixture of flushing gas and air is exhausted during the flushing process by means of a vacuum pump which is synchronized or substantially synchronized with the feed of the flushing gas.

In at least one possible embodiment of the present application, the carbon dioxide gas may be permitted to flow through the flushing tube when the valve on the tube is opened. Because carbon dioxide is heavier than atmospheric air, the carbon dioxide may naturally flow through the tube and into the beverage can. However, in one possible embodiment, the source of carbon dioxide may be pressurized. In such an embodiment, the carbon dioxide is forced through the tube when the valve is opened and is further forced into the can.

Because the introduction of flushing gas into the can with the flushing gas tube and the removal of the gas from the can with the exhaust line are simultaneous or substantially simultaneous, the formation of a vacuum in the can is avoided, restricted, and/or minimized, and therefore implosion of the can is also avoided, restricted, and/or minimized.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Additional features and details of the present application are described in greater detail below and with reference to the accompanying drawings, in which.

DESCRIPTION OF EMBODIMENT OR EMBODIMENTS

Figure 1:
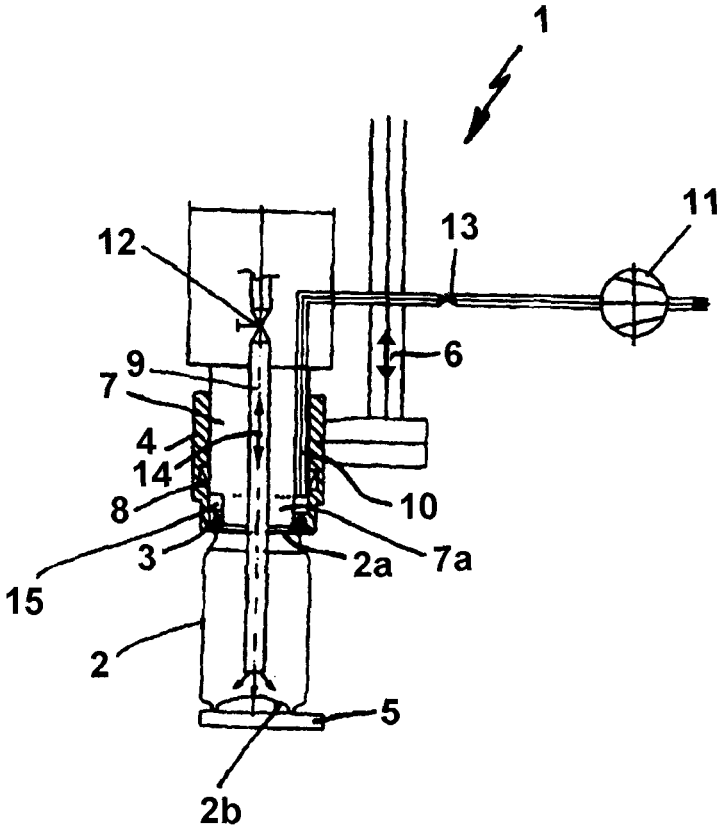
FIG. 1 is a somewhat simplified illustration of an apparatus according to the present application in the flushing position.

The apparatus which is designated 1 in general is used for the introduction of a flushing and displacement gas into cans 2 to be filled with foods or beverages. To fill the can 2 with flushing gas, first a sleeve 4 provided with a bottom sealing ring 3 is pressed against the edge of the can which is designated 2*a*, whereby the can is resting on a corresponding support 5. The sleeve 4 is raised and lowered with a raising and lowering mechanism which is not illustrated in any detail but is identified by the double arrow 6.

A sleeve 4, which is sealed gas-tight against the valve cylinder 7 by means of seals 8, is guided so that it can be raised and lowered on the valve cylinder 7.

A flushing gas tube 9 is centrally positioned in the valve cylinder 7. On the outside edge there are one or more exhaust gas lines 10 which are provided with a vacuum pump 11. The flushing gas line 9 is lowered until it is in the vicinity of the bottom 2*b* of the can 2, e.g. far enough so that carbon dioxide can be discharged from it.

In FIG. 1, the valve provided in the flushing gas tube is designated 12 and the valve in the discharge gas line is designated 13. The double arrow in the flushing gas tube 9 that indicates the raising and lowering is designated 14.

The operation of the apparatus according to the present application is described below:

First, a can 2 which is later to be filled with a food or beverage is delivered to the position of the apparatus according to the present application, e.g. by means of a support or a transport element 5. When the can 2 is in the correct or desired position, the sleeve 4 is lowered (double arrow 6) by means of an apparatus which is not illustrated in any further detail over the can until it contacts the upper edge 2*a* of the can with its sealing ring 3 and creates a seal between the can and the environment.

In synchronization with or separately from this downward movement indicated by the double arrow 6, the flushing gas tube 9 guided in the valve cylinder 7 is lowered into the can 2 (double arrow 14). The valve cylinder 7 is equipped on its end pointing toward the can 2 with an area 7*a* which has a smaller diameter, so that when the valve cylinder 7 is in the operating position, the gas that escapes from the can during the flushing can be exhausted via the exhaust gas line 10 by means of the vacuum pump 11.

To admit the flushing gas into the interior of the can, the valve 12 is opened and the valve 13 of the exhaust gas line and the vacuum pump 11, if one is present, are simultaneously or substantially simultaneously put into operation.

The flushing process itself is timed and ends with the passage of the pre-selected length of time. For this purpose the flushing gas tube valve 12 and the exhaust line valve are closed, whereupon the other process steps for the filling of the can are carried out. When the filling of the can has been completed, the sleeve 4 is raised from the can and the can, which is now filled, can be transported for additional process steps such as closing, for example.

In addition to the timed termination of the flushing process, a sensor-control of the flushing process can also be provided, for example. For example, sensors for gas pressure or for the determination of the flushing gas concentration can be provided which, when the specified reference value or desired value is reached, trigger the termination of the flushing process.

With an apparatus 1 and a method for the introduction of a flushing or displacement gas into cans 2 to be filled with foods or beverages, in one possible embodiment beverage cans, the object of the present application is to provide a solution with which an optimal flushing action of cans filled with foods and beverages can be achieved, without polluting the environment with excessive carbon dioxide levels, for example.

The present application teaches that this object can be accomplished by a sleeve 4 that can be raised and lowered until it comes into contact by means of a seal 3 with the upper edge 2*a* of the can, in which sleeve 4 a flushing gas tube 9 is guided so that it can be raised and lowered, and which is equipped with a gas exhaust line 10, whereby the flushing gas tube is introduced into the can until it is a short distance above the bottom of the can.

Figure 1A:
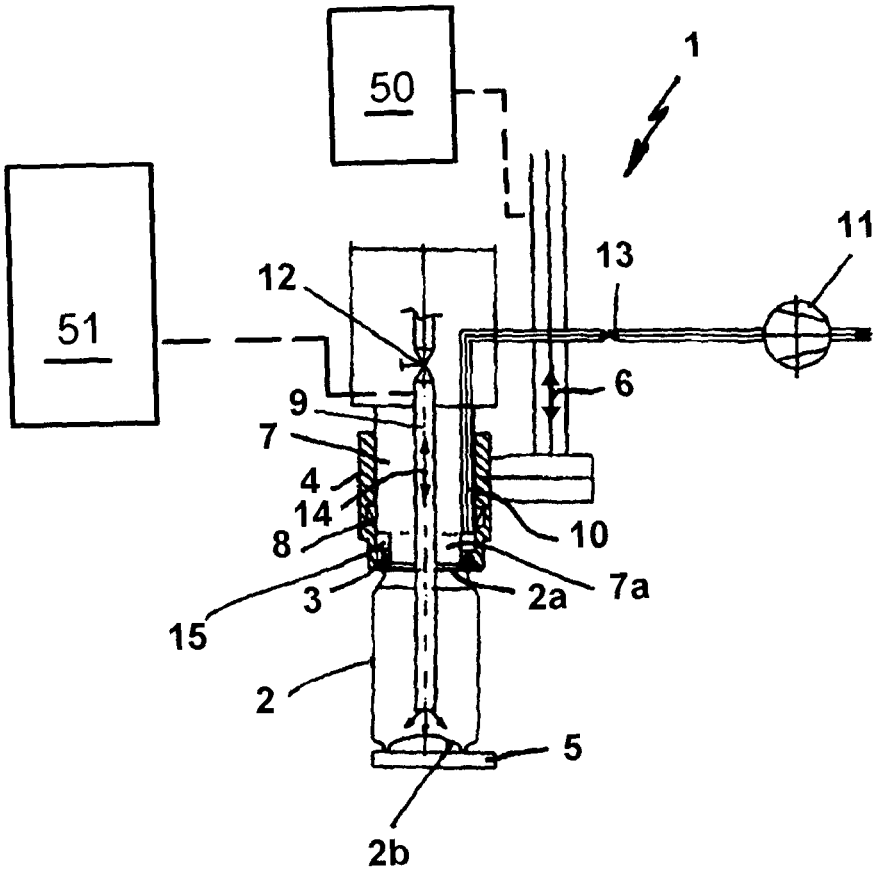
FIG. 1A shows another possible embodiment of the present application.

FIG. 1A shows another possible embodiment of the application. Included in FIG. 1A is a raising and lowering device 50. The raising and lowering device 50 is configured to raise and lower the sleeve or sealing arrangement 4 along the central valve cylinder 7. Additionally seen in FIG. 1A is a raising and lowering device 51, which is configured to raise and lower the flushing gas tube 9 in and out of cans 2.

Figure 2:
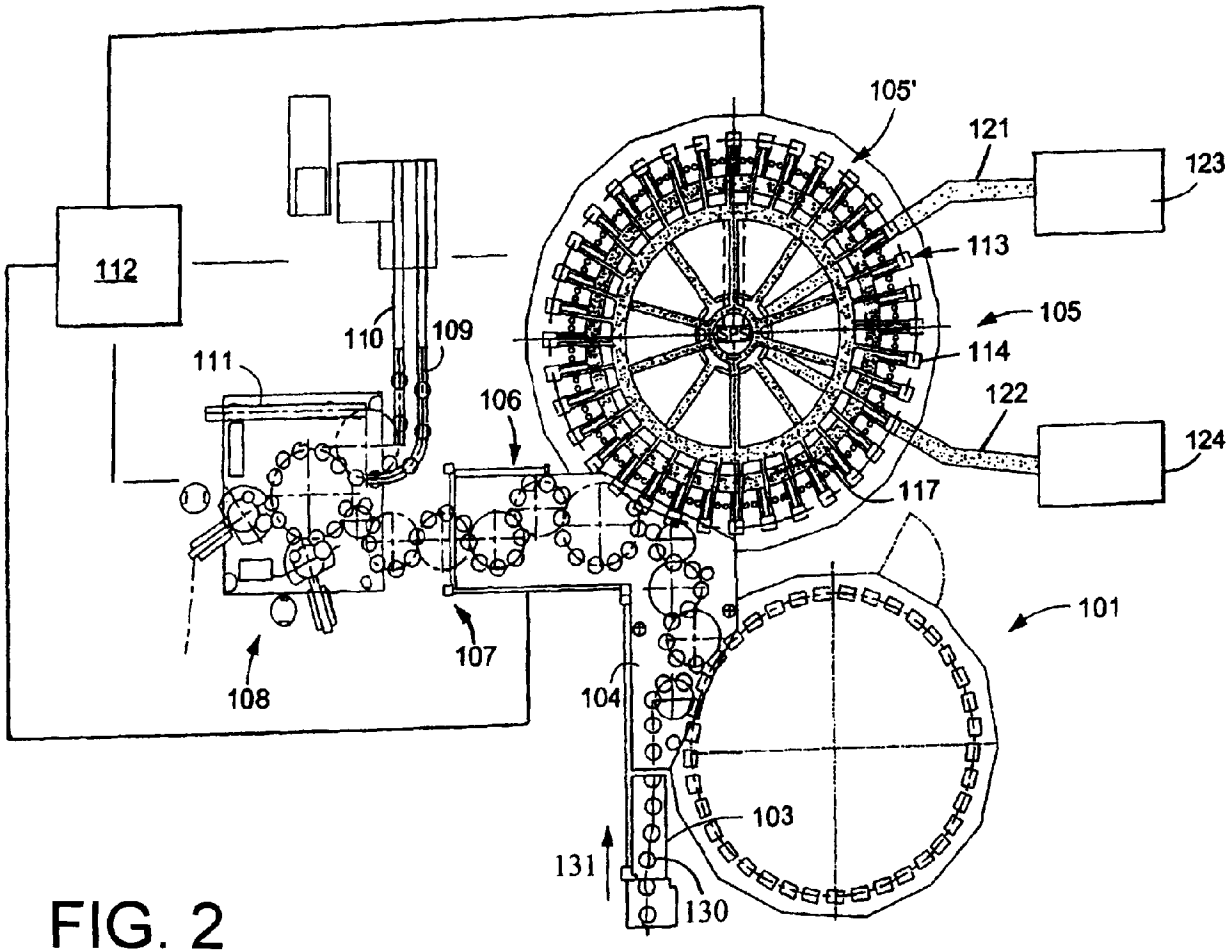
FIG. 2 shows schematically the main components of one possible embodiment example of a system for filling containers, for example a beverage bottling plant for filling bottles with at least one liquid beverage, in accordance with at least one possible embodiment, in which system or plant could possibly be utilized at least one aspect, or several aspects, of the embodiments disclosed herein.

FIG. 2 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 2 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 2, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

One feature or aspect of an embodiment is believed at the time of the filing of this patent application to possibly reside broadly in an apparatus 1 for the introduction of a flushing or displacement gas into cans 2 to be filled with food or beverage, in one possible embodiment beverage cans, comprising a sleeve 4 which can be raised and lowered and comes into contact by means of a seal 3 with the upper edge 2*a* of the can, in which sleeve a flushing gas tube 9 is guided so that it can be raised and lowered, and which is equipped with a gas exhaust line 10, and the flushing gas tube 9 is realized so that it can be introduced into the vicinity of the bottom of the cans 2 to be filled.

Another feature or aspect of an embodiment is believed at the time of the filing of this patent application to possibly reside broadly in the apparatus, comprising a central valve cylinder 7 which guides the flushing gas tube 9, which valve cylinder is surrounded by the sleeve 4 that carries the sealing ring 3 and is sealed from it, and has a terminal section 7*a* with a tapered diameter, whereby the exhaust gas line 10 proceeds from the shoulder thus formed.

Yet another feature or aspect of an embodiment is believed at the time of the filing of this patent application to possibly reside broadly in the apparatus, wherein the terminal section 7*a* with the tapered diameter of the central valve cylinder 7 has an outside diameter which is smaller than the inside diameter of the terminal section of the sleeve 4 that carries the edge seal, thereby forming an exhaust gas space.

Still another feature or aspect of an embodiment is believed at the time of the filing of this patent application to possibly reside broadly in the apparatus, wherein a vacuum pump 1 is associated with the exhaust gas line 10.

A further feature or aspect of an embodiment is believed at the time of the filing of this patent application to possibly reside broadly in a method for the introduction of a flushing or displacement gas into cans to be filled with foods or beverages, in one possible embodiment beverage cans, wherein a sleeve which is provided with a sealing ring is lowered onto the upper edge of a can to be flushed and is positioned tightly against it, then a valve cylinder that carries the flushing gas delivery tube and an exhaust line is lowered into the can so that the discharge opening of the flushing gas tube is in the vicinity of the bottom of the can, leaving a space for the discharge of the gas, and then the flushing gas delivery tube and the exhaust gas tube are opened until the can is completely or substantially completely filled with flushing gas.

Another feature or aspect of an embodiment is believed at the time of the filing of this patent application to possibly reside broadly in the method, wherein the mixture of flushing gas and air is exhausted during the flushing process by means of a vacuum pump which is synchronized or substantially synchronized with the flushing gas feed.

Yet another feature or aspect of an embodiment is believed at the time of the filing of this patent application to possibly reside broadly in a method for the filling of beverage cans in a beverage can filling plant, said method comprising the steps of: moving a can to be filled into a beverage can filling machine; lowering a telescoping sleeve into sealing engagement with the top portion of said can; inserting a tube configured to flush cans with carbon dioxide into said can a predetermined distance from a bottom surface of said can; opening a valve operatively connected to said tube and flowing carbon dioxide through said tube into the bottom of said can, and flushing air in said can upwardly out of said can, and substantially simultaneously opening a valve of an exhaust tube and removing the air and a portion of the carbon dioxide being flushed out of said can with a vacuum pump operatively connected to said exhaust tube, wherein the rate of flow of carbon dioxide into said can and the rate of flow of air out of said can are sufficiently balanced to minimize distortion of said can by the negative vacuum pressure created by said vacuum pump; substantially simultaneously closing said valve of said exhaust tube and closing said valve of said tube configured to flush cans with carbon dioxide after a predetermined period of time has elapsed; filling said can with a beverage; removing said tube from said can; and closing said filled can.

Still another feature or aspect of an embodiment is believed at the time of the filing of this patent application to possibly reside broadly in a method for the filling of cans in a can filling plant, said method comprising the steps of: moving a can to be filled into a can filling machine; lowering a sealing arrangement into sealing engagement with said can and sealing said sealing arrangement onto said can; inserting a tube into said can, which tube is configured to flush cans with a gas; flowing a flushing gas through said tube into a bottom portion of said can; flushing atmospheric air and a portion of the flushing gas from said can and flowing atmospheric air and a portion of the flushing gas through a gas exhaust line; stopping said flowing and said flushing and stopping the exhaust of atmospheric air and a portion of the flushing gas; removing said tube from said can; raising said sealing arrangement out of sealing engagement with said can; filling said can; and closing said can.

A further feature or aspect of an embodiment is believed at the time of the filing of this patent application to possibly reside broadly in a flushing arrangement for performing a method for the filling of cans in a can filling plant, said flushing arrangement comprising: a moving arrangement being configured to move a can to be filled into a can filling machine; a lowering arrangement being configured to lower a sealing arrangement into sealing engagement with a can and seal said sealing arrangement onto the can; an inserting arrangement being configured to insert a tube into a can, which tube is configured to flush cans with a gas; a flowing arrangement being configured to flow a flushing gas through said tube into a bottom portion of a can; a flushing arrangement being configured to flush atmospheric air and a portion of the flushing gas from a can and flow atmospheric air and a portion of the flushing gas through a gas exhaust line; a stopping arrangement being configured to stop the flowing and the flushing and stop the exhaust of atmospheric air and a portion of the flushing gas; a removing arrangement being configured to remove said tube from a can; said lowering arrangement being further configured to raise said sealing arrangement out of sealing engagement with a can; a filling arrangement being configured to fill a can; and a closing arrangement being configured to close a can.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

Some examples of timer apparatus that may possibly be utilized or possibly adapted for use in at least one possible embodiment of the present application may possibly be found in the following U.S. patents: U.S. Pat. No. 5,910,739 issued to Stanojevic on Jun. 8, 1999; No. 5,999,087 issued to Gunton on Dec. 7, 1999; No. 6,016,531 issued to Rixner et al. on Jan. 18, 2000; No. 6,020,697 issued to Stenger et al. on Feb. 1, 2000; No. 6,020,775 issued to Chevallier on Feb. 1, 2000; and No. 6,038,197 issued to Phillips on Mar. 14, 2000.

Some examples of gas pressure sensors which may possibly be utilized or adapted for use in at least one possible embodiment of the present application may possibly be found in the following U.S. patents: U.S. Pat. No. 4,703,657, having the title "GAS PRESSURE SENSOR," published on Nov. 3, 1987; No. 4,812,801, having the title "SOLID STATE GAS PRESSURE SENSOR," published on Mar. 14, 1989; No. 5,597,020, having the title "METHOD AND APPARATUS FOR DISPENSING NATURAL GAS WITH PRESSURE CALIBRATION," published on Jan. 28, 1997; No. 5,763,762, having the title "TOTAL DISSOLVED GAS PRESSURE SENSOR, REPLACEABLE COLLECTOR MODULE AND PROCESS," published on Jun. 9, 1998; and No. 5,925,823, having the title "ALPHA-PARTICLE GAS-PRESSURE SENSOR," published on Jul. 20, 1999.

Some examples of gas concentration sensors or apparatuses for the determination of gas concentration which may possible by utilized or adapted for use in at least one possible embodiment of the present application may possibly be found in the following U.S. patents: U.S. Pat. No. 7,519,479, having the title "SLOPE DETECTION FOR MEASURING GAS CONCENTRATION," published on Apr. 14, 2009; No. 7,445,698, having the title "GAS CONCENTRATION DETECTING APPARATUS," published on Nov. 4, 2008; No. 7,404,880, having the title "SENSOR ELEMENT," published on Jul. 29, 2008; and U.S. Pat. No. 5,820,745, having the title "METHOD OF MEASURING THE CONCENTRATION OF A GAS IN A GAS MIXTURE AND ELECTROCHEMICAL SENSOR FOR DETERMINING THE GAS CONCENTRATION," published on Oct. 13, 1998.

All of the patents, patent applications or patent publications, which were cited in the German Office Action dated Oct. 9, 2007, and/or cited elsewhere are hereby incorporated by reference as if set forth in their entirety herein as follows: DE 40 36 290, having the following German title "VERFAHREN UND VORRICHTUNG ZUM STERILEN ABFUELLEN VON GETRAENKEFLUESSIGKEITEN," published on Dec. 12, 1991; EP 0 614 850, having the following English translation of the German title "FILLING HEAD FOR FILLING MACHINES FOR FILLING BOTTLES OR SIMILAR CONTAINERS WITH A LIQUID," published on Sep. 14, 1994; and DE 38 36 489, having the following English translation of the German title "METHOD AND DEVICE FOR FILLING CANS WITH DRINKS," published May 3, 1990.

All of the patents, patent applications or patent publications, which were cited in the International Search Report dated Mar. 4, 2008, and/or cited elsewhere are hereby incorporated by reference as if set forth in their entirety herein as follows: US 2004/222224, having the title "SYSTEM AND METHOD FOR ASEPTIC FILLING OF PACKAGES WITH LIQUID PRODUCTS," published on Nov. 11, 2004; EP 1,236,521, having the title "DEVICE FOR CLEANING THE INNER SURFACES OF CONTAINERS IN GENERAL," published on Sep. 4, 2002; and US 2004/208781, having the title "ARTICLE STERILIZING METHODS AND STERILIZING DEVICE," published on Oct. 21, 2004.

U.S. patent application Ser. No. 12/429,809, filed on Apr. 24, 2009, is hereby incorporated by reference as if set forth in their entirety herein.

The patents, patent applications, and patent publication listed above in the preceding six paragraphs are herein incorporated by reference as if set forth in their entirety. The purpose of incorporating U.S. patents, Foreign patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 051 237.5, filed on Oct. 31, 2006, having inventors Thomas STOLTE and Timo JAKOB, and DE-OS 10 2006 051 237.5 and DE-PS 10 2006 051 237.5, and International Application No. PCT/EP2007/009357, filed on Oct. 29, 2007, having WIPO Publication No. WO2008/052724 and inventors Thomas STOLTE and Timo JAKOB, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the Foreign equivalent patent application PCT/EP2007/009357 and German Patent Application 10 2006 051 237.5 is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/009357 and DE 10 2006 051 237.5 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Apparatus
2 Can
2*a* Can edge
2*b* Can bottom
3 Sealing ring
4 Sleeve
5 Support
6 Double arrow
7 Valve cylinder
7*a* Valve cylinder end
8 Seals
9 Flushing gas tube
10 Exhaust gas line
11 Vacuum pump
12 Flushing gas tube valve
13 Exhaust gas valve
14 Double arrow
15 Annular space

What is claimed is:

1. A method of flushing an empty food or beverage can, using a flushing arrangement comprising a valve cylinder, a tube disposed at least partially within said valve cylinder, a sleeve disposed about an outer surface of said valve cylinder, and an exhaust gas line, a portion of which is formed in and as part of said valve cylinder, and is disposed a distance and separate from said tube, said method comprising the steps of:

moving said sleeve, with respect to said valve cylinder, and thereby moving a sealing portion of said sleeve past a lower end surface of said valve cylinder and into sealing engagement with an empty can filled with air, and thereby sealing the space between said valve cylinder and the sealed empty can;

moving said tube, with respect to said valve cylinder, and thereby inserting said tube into the sealed empty can through a can opening in the sealed empty can;

flowing a flushing gas through said tube and out of a discharge end of said tube, and thereby filling the sealed empty can with flushing gas and flushing air out of the sealed empty can; and exhausting the air by flushing the air into said sealed space between said valve cylinder and the sealed empty can, then through an inlet opening of said exhaust gas line disposed in said lower end surface of said valve cylinder, and then through said exhaust gas line and out of said flushing arrangement.

2. The method according to claim 1, wherein said steps of flowing said flushing gas and exhausting the air are performed simultaneously.

3. The method according to claim 2, wherein:

said tube is of a length sufficient to traverse a substantial portion of the height of the empty can;

said step of inserting said tube into the empty can comprises moving said discharge end to a position a short distance from a bottom interior surface of the empty can; and said step of flowing said flushing gas comprises flowing flushing gas into a bottom portion of the empty can and thereby pushing air up and out of the empty can.

4. The method according to claim 3, wherein:

said valve cylinder comprises a first portion of a first diameter, and a second portion of a second diameter that is less than both said first diameter and an inner diameter of said sleeve;

said lower end surface of said valve cylinder is disposed on said first portion; and said second portion is disposed to project out from said lower end surface into said sealed space between said valve cylinder and the sealed empty can, to thereby reduce the volume of said sealed space and form, together with said lower end surface and said sleeve, an exhaust gas channel configured to guide exhausted flushed air to said inlet opening; and said step of exhausting the air comprises guiding exhausted air through said exhaust gas channel to said inlet opening.

5. The method according to claim 4, wherein:

said flushing arrangement further comprises a vacuum arrangement operatively connected to said exhaust gas line; and said method further comprises drawing flushed air through said exhaust gas line using said vacuum arrangement.

6. The method according to claim 5, wherein:

said flushing arrangement further comprises a movable arm connected to said sleeve; and said method further comprises moving said movable arm up and down and thereby raising and lowering said sleeve.

7. The method according to claim 1, wherein:

said tube is of a length sufficient to traverse a substantial portion of the height of the empty can;

said step of inserting said tube into the empty can comprises moving said discharge end to a position a short distance from a bottom interior surface of the empty can; and said step of flowing said flushing gas comprises flowing flushing gas into a bottom portion of the empty can and thereby pushing air up and out of the empty can.

8. The method according to claim 1, wherein:

said valve cylinder comprises a first portion of a first diameter, and a second portion of a second diameter that is less than both said first diameter and an inner diameter of said sleeve;

said lower end surface of said valve cylinder is disposed on said first portion; and said second portion is disposed to project out from said lower end surface into said sealed space between said valve cylinder and the sealed empty can, to thereby reduce the volume of said sealed space and form, together with said lower end surface and said sleeve, an exhaust gas channel configured to guide exhausted flushed air to said inlet opening; and said step of exhausting the air comprises guiding exhausted air through said exhaust gas channel to said inlet opening.

9. The method according to claim 1, wherein:

said flushing arrangement further comprises a vacuum arrangement operatively connected to said exhaust gas line; and said method further comprises drawing flushed air through said exhaust gas line using said vacuum arrangement.

10. The method according to claim 1, wherein:

said flushing arrangement further comprises a movable arm connected to said sleeve; and said method further comprises moving said movable arm up and down and thereby raising and lowering said sleeve.

11. A flushing arrangement for flushing an empty food or beverage can, said flushing arrangement comprising:

a valve cylinder and a tube disposed at least partially within said valve cylinder;

a sleeve disposed about an outer surface of said valve cylinder;

said sleeve being movable with respect to said valve cylinder;

said sleeve being movable to bring a sealing portion of said sleeve into sealing engagement with an empty can filled with air;

said tube being movable with respect to said valve cylinder, and being configured to be inserted into the sealed empty can through a can opening in the sealed empty can;

said tube being configured to permit flow of a flushing gas therethrough and out of a discharge end of said tube to fill the sealed empty can with flushing gas and thereby flush air out of the sealed empty can;

an exhaust gas line configured to exhaust flushed air;

a portion of said exhaust gas line being formed in and as part of said valve cylinder, and being disposed a distance and separate from said tube;

said exhaust gas line comprises an inlet opening disposed in a lower end surface of said valve cylinder;

said sealing portion of said sleeve is configured to project past said lower end surface of said valve cylinder upon said sleeve being moved into sealing engagement with the empty can to seal the space between said valve cylinder and the sealed empty can; and said inlet opening is configured to receive air flushed out of the sealed empty can through the can opening upon flushing gas being flowed out of said tube into the sealed empty can.

12. The flushing arrangement according to claim 11, wherein said tube is of a length sufficient to traverse a substantial portion of the height of the empty can, such that, upon insertion of said tube into the empty can, said discharge end is positioned a short distance from a bottom interior surface of the empty can.

13. The flushing arrangement according to claim 12, wherein:

said valve cylinder comprises a first portion of a first diameter, and a second portion of a second diameter that is less than both said first diameter and an inner diameter of said sleeve;

said lower end surface of said valve cylinder is disposed on said first portion; and said second portion is disposed to project out from said lower end surface into said sealed space between said valve cylinder and the sealed empty can, to thereby reduce the volume of said sealed space and form, together with said lower end surface and said sleeve, an exhaust gas channel configured to guide exhausted flushed air to said inlet opening.

14. The flushing arrangement according to claim 13, wherein said flushing arrangement further comprises a vacuum arrangement operatively connected to said exhaust gas line and configured to draw flushed air through said exhaust gas line.

15. The flushing arrangement according to claim 14, wherein said flushing arrangement further comprises a movable arm connected to said sleeve and configured to be moved up and down to raise and lower said sleeve.

16. The flushing arrangement according to claim 11, wherein:

said valve cylinder comprises a first portion of a first diameter, and a second portion of a second diameter that is less than both said first diameter and an inner diameter of said sleeve;

said lower end surface of said valve cylinder is disposed on said first portion; and said second portion is disposed to project out from said lower end surface into said sealed space between said valve cylinder and the sealed empty can, to thereby reduce the volume of said sealed space and form, together with said lower end surface and said sleeve, an exhaust gas channel configured to guide exhausted flushed air to said inlet opening.

17. The flushing arrangement according to claim 11, wherein said flushing arrangement further comprises a vacuum arrangement operatively connected to said exhaust gas line and configured to draw flushed air through said exhaust gas line.

18. The flushing arrangement according to claim 11, wherein said flushing arrangement further comprises a movable arm connected to said sleeve and configured to be moved up and down to raise and lower said sleeve.

* * * * *